US006786346B1

(12) United States Patent
Gurnard et al.

(10) Patent No.: US 6,786,346 B1
(45) Date of Patent: Sep. 7, 2004

(54) SECURITY CLOSURE FOR A CONTAINER

(76) Inventors: Ted Gurnard, 4820 Shooting Star Rd., Pollock Pines, CA (US) 95726; Richard Wagner, 1605 Stanford St., Concord, CA (US) 94519

( * ) Notice: Subject to any disclaimer, the term of this patent is extended or adjusted under 35 U.S.C. 154(b) by 64 days.

(21) Appl. No.: 10/211,105

(22) Filed: Aug. 1, 2002

(51) Int. Cl.[7] ..... B65D 45/32

(52) U.S. Cl. ..... 215/272; 215/275; 215/291; 220/320

(58) Field of Search ..... 215/204, 207, 215/272, 273, 275, 280, 284, 291; 220/315, 319, 320, 321, 210

(56) References Cited

U.S. PATENT DOCUMENTS

| | | | | | |
|---|---|---|---|---|---|
| 620,623 | A | * | 3/1899 | Weissenthanner | 215/275 |
| 1,467,254 | A | | 9/1923 | Tarbet | |
| 1,472,889 | A | * | 11/1923 | Ruggiero | 215/275 |
| 2,186,518 | A | | 1/1940 | Buono | |
| 2,421,356 | A | | 5/1947 | Saffady | |
| 2,812,093 | A | * | 11/1957 | Podesta | 215/275 |
| 3,499,574 | A | | 3/1970 | Yates, Jr. | |
| 3,616,955 | A | | 11/1971 | Heffran | |
| 3,642,166 | A | * | 2/1972 | Starr | 220/320 |
| 3,850,324 | A | | 11/1974 | Meyer | |
| 3,851,788 | A | * | 12/1974 | Hammes | 220/319 |
| 3,942,677 | A | * | 3/1976 | Hagen et al. | 215/272 |
| 4,805,798 | A | * | 2/1989 | Stolzman | 220/320 |
| D312,400 | S | | 11/1990 | Schwaikert | |
| 5,020,839 | A | * | 6/1991 | Kalb | 220/321 |
| 5,102,002 | A | | 4/1992 | Whitley | |
| 5,284,270 | A | * | 2/1994 | Kusta | 220/321 |
| 5,299,707 | A | * | 4/1994 | Stolzman | 220/321 |
| 5,531,082 | A | | 7/1996 | Wolk et al. | |
| 6,126,213 | A | | 10/2000 | Jones et al. | |
| 6,631,629 | B1 | * | 10/2003 | Fuss et al. | 70/57.1 |

* cited by examiner

*Primary Examiner*—Nathan J. Newhouse
(74) *Attorney, Agent, or Firm*—Thomas R. Lampe

(57) ABSTRACT

A security closure for enclosing the top opening of a container includes a cap having a plurality of flexible, independently movable skirt portion segments which are positionable under a rib of the container. A wire engaging the skirt portion segments cooperates with a pivoted lever to move the skirt portion segments into latching position relative to the container and a lock is employed to maintain the wire tightened against the skirt portion segments.

9 Claims, 3 Drawing Sheets

SECURITY CLOSURE FOR A CONTAINER

TECHNICAL FIELD

This invention relates to a security closure for closing the top opening of a container to-prevent access to the contents of the container. The invention has particular applicability for use with a drinking glass, being utilized for example to prevent introduction of drugs or other harmful substances into a drink held by the glass.

BACKGROUND OF THE INVENTION

Drugs or other harmful substances occasionally have been added to drinks without the knowledge of the persons consuming the drinks. Some of these substances, known as "date rape" drugs, have been added to the drinks of women in public bars to reduce their ability to ward off sexual advances.

As will be seen below, the present invention relates to a security closure which may be utilized with a container to protect the contents of the container. The security closure of the invention, when employed with a drinking glass, may be readily applied and removed by an individual wishing to protect her or his drink.

A search directed to the present invention located the following patents: U.S. Pat. No. 5,531,082, issued Jul. 2, 1996, U.S. Pat. No. 6,126,213, issued Oct. 3, 2000, U.S. Pat. No. 2,421,356, issued May 27, 1947, U.S. Pat. No. 3,850, 324, issued Nov. 26, 1974, U.S. Pat. No. 1,467,254, issued Sept. 4, 1923, U.S. Pat. No. 3,616,955, issued Nov. 2, 1971, U.S. Pat. No. 5,102,002, issued Apr. 7, 1992, U.S. Pat. No. 3,499,574, issued Mar. 10, 1970, U.S. Pat. No. 2,186,518, issued Jan. 9, 1940, and U.S. Pat. No. DES.312,400, issued Nov. 27, 1990.

The located patents do not teach or suggest the invention disclosed and claimed herein.

DISCLOSURE OF INVENTION

The present invention relates to a security closure for closing the top opening of a container such as a drinking glass having outwardly projecting structure extending from the outer periphery thereof adjacent to the top opening.

The security closure includes a cap having a top cap portion for positioning over the top opening of the container and a skirt portion projecting downwardly from the top cap portion for extending around the outwardly projecting structure of the container.

The skirt portion includes flexible, independently movable skirt portion segments having inwardly projecting latch elements for selective positioning under the outwardly projecting structure of the container to prevent removal of the cap from the container and prevent access to contents of the container.

The security closure also includes mover structure cooperable with the flexible skirt portion segments to flex the flexible skirt portion segments inwardly to position the latch elements under the outwardly projecting structure of the container.

A lock is provided which is cooperable with the mover structure to maintain the flexible skirt portion segments flexed inwardly and to maintain the latch elements under the outwardly projecting structure of the container.

The mover structure includes an elongated constrictor member looping about the flexible skirt portion segments and a manually operable structural element operatively associated with the elongated constrictor member to tighten the elongated constrictor member and cause the elongated constrictor member to bear tightly against the flexible skirt portion segments, causing the flexible skirt portion segments to flex inwardly.

Other features, advantages and objects of the present invention will become apparent with reference to the following description and accompanying drawings.

BEST MODE FOR CARRYING OUT THE INVENTION

Figure 1:
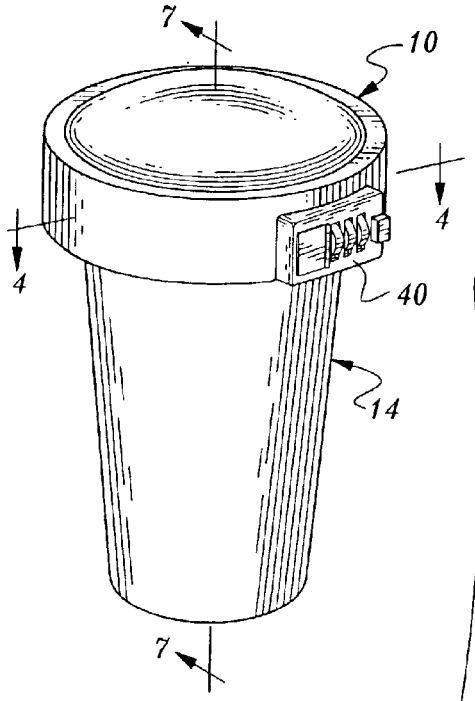
FIG. 1 is a perspective view illustrating a preferred form of security closure constructed in accordance with the teachings of the present invention positioned on a drinking glass.
Figure 2:
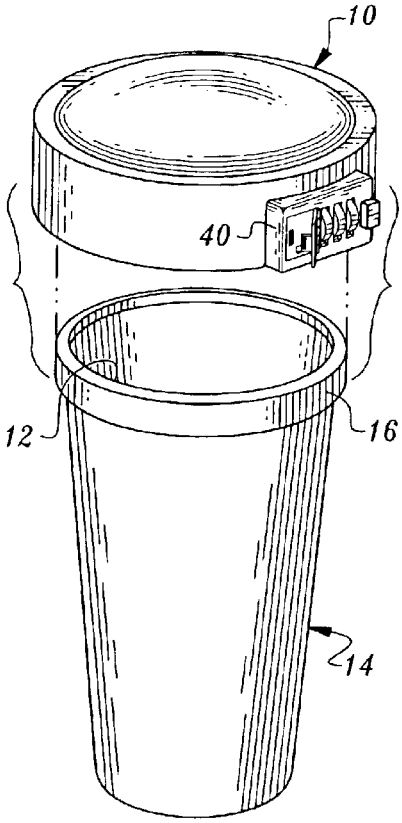
FIG. 2 is an exploded, perspective view illustrating the security closure removed from the drinking glass.
Figure 7:
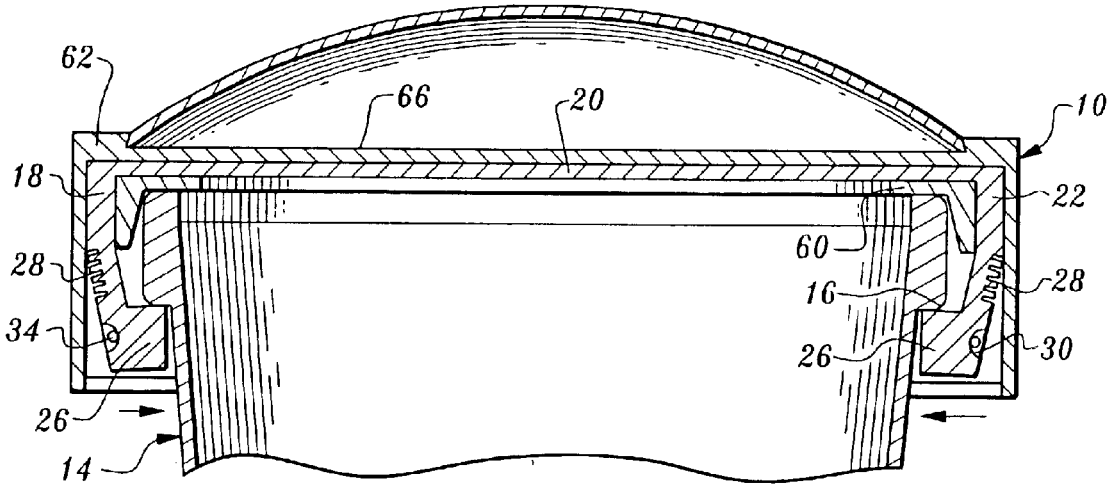
FIG. 7 is an enlarged, cross-sectional view taken along line 7—7 in FIG. 1, illustrating the security closure locked into position on the container.
Figure 8:
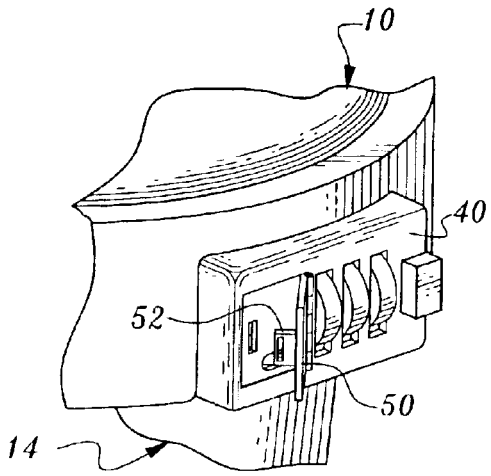
FIG. 8 is a view similar to FIG. 5, but illustrating the lever in unlatched condition, allowing the security closure to be removed from the container.
Figure 10:
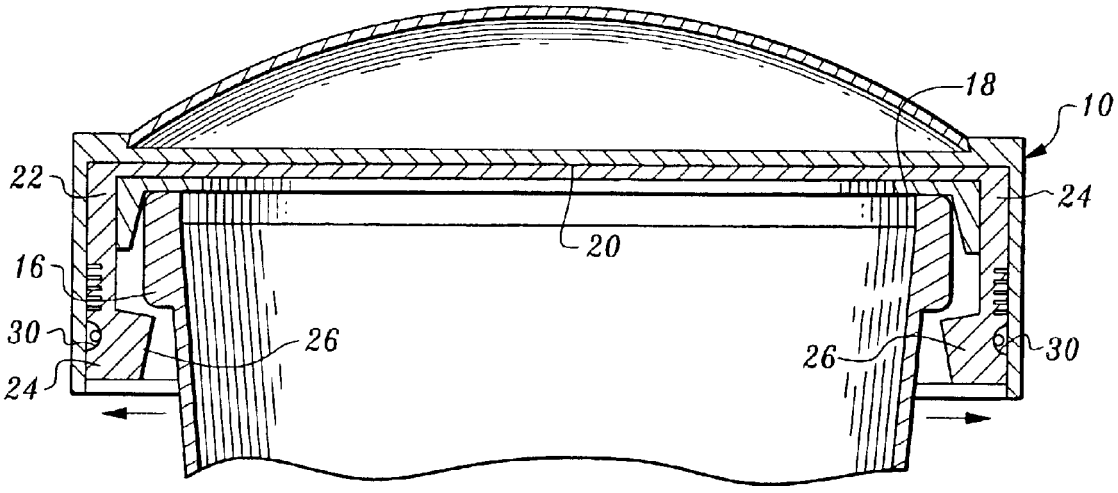
FIG. 10 is a view similar to FIG. 7, but illustrating the security closure in condition to be removed from the container.

Referring now to the drawings, a security closure constructed in accordance with the teachings of the present invention is designated by reference numeral 10. The security closure 10 is utilized to close the top opening 12 of a container in the form of a drinking glass 14. FIGS. 1, 7 and 10, for example, illustrate the security closure positioned on the container.

The drinking glass 14 has outwardly projecting structure in the form of a continuous rib 16 adjacent to the top opening thereof.

The security closure 10 includes a cap 18 having a top cap portion 20 for positioning over the top opening of the container and a skirt portion 22 projecting downwardly from the top cap portion for extending around the rib 16 of the container. The cap, as illustrated, is of integral construction, being suitably formed, for example, from molded plastic, although other materials may be utilized.

The skirt portion 22 includes a plurality of flexible, independently movable skirt portion segments 24 having inwardly projecting latch elements 26 for selective positioning under the rib 16 of the container to prevent removal of the cap from the container and prevent access to the contents of the container.

Figure 3:
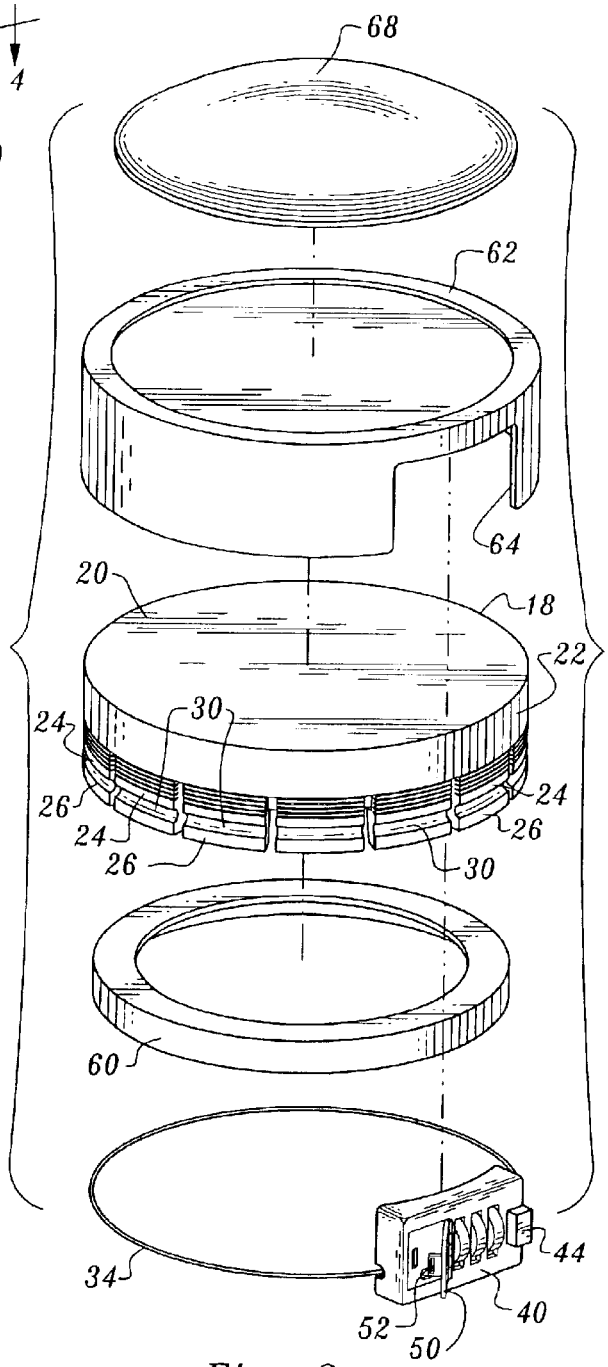
FIG. 3 is an exploded, perspective view illustrating components of the security closure.
Figure 4:
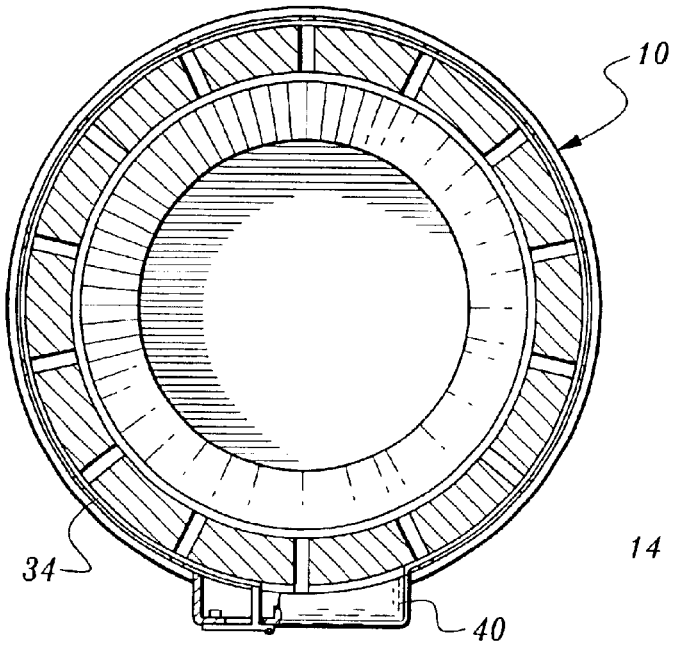
FIG. 4 is an enlarged, cross-sectional view taken along the line 4—4 in FIG. 1.
Figure 5:
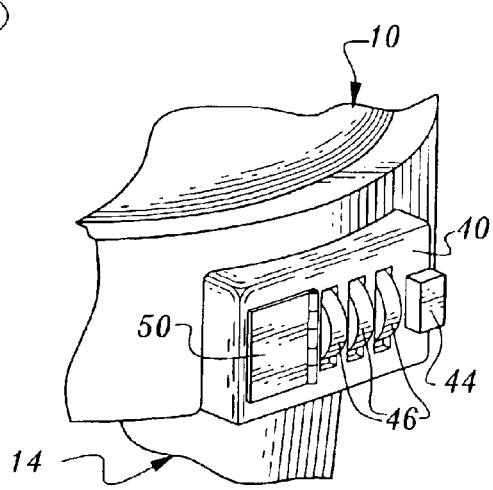
FIG. 5 is an enlarged, perspective view illustrating a lock and related structure, including an associated lever of the device, selected portions of other components of the security closure and container also being illustrated.

In the absence of outside forces being applied thereto, the skirt portion segments 24 have the configuration shown in FIGS. 3 and 10 wherein the latch elements 26 can be pulled over rib 16 to either apply the security closure to the container or remove it therefrom, the flexibility of the skirt portion segments allowing for this. When, however, the skirt portion segments are flexed inwardly, as shown in FIG. 7 for example, the cap 18 is locked in place due to the fact that the latch elements 26 are under the rib. Serrations 28 on the skirt portion segments contribute to the flexibility of the skirt portion segments.

The flexible skirt portion segments 24 have aligned outer grooves 30. Positioned within these grooves and looping about the flexible skirt portion segments 24 is an elongated constrictor member in the form of a double-ended wire 34.

One end of the wire 34 is attached to a combination lock 40. The internal mechanism of lock 40 is of conventional construction and lock 40 may suitably be essentially the ordinary type of combination lock utilized on brief cases, attache cases and the like. The lock 40 includes a latch 42 which may be moved between an extended position (shown in FIG. 6 for example) and a retracted position (shown in FIG. 9, for example). Also as is conventional, the lock 40 includes a push button 44 utilized to initiate retraction of the latch and rotatable combination lock elements 46. These specific combination lock mechanisms are well known, do not comprise part of the present invention and need not be described in detail.

Figure 6:
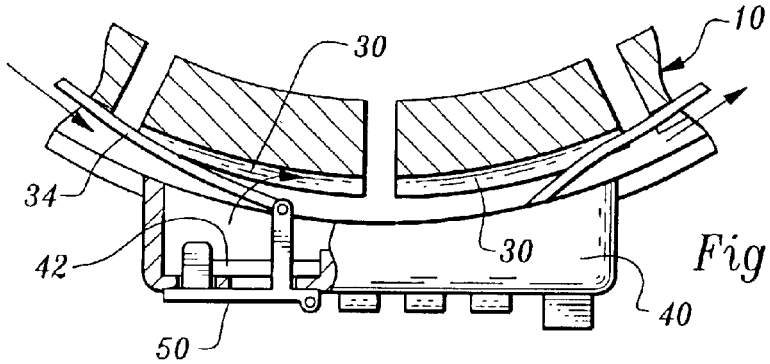
FIG. 6 is an enlarged, top, sectional view of a portion of the structure illustrated in FIG. 4, illustrating cooperating structural elements of the security closure positioned to lock the security closure on the container.

Operatively associated with lock 40 and pivotally mounted thereon is a lever 50 defining a hole 52 for receiving the latch 42 when latch 42 is in extended position and when the pivoted lever 50 is closed and in the position shown in FIG. 6.

Figure 9:
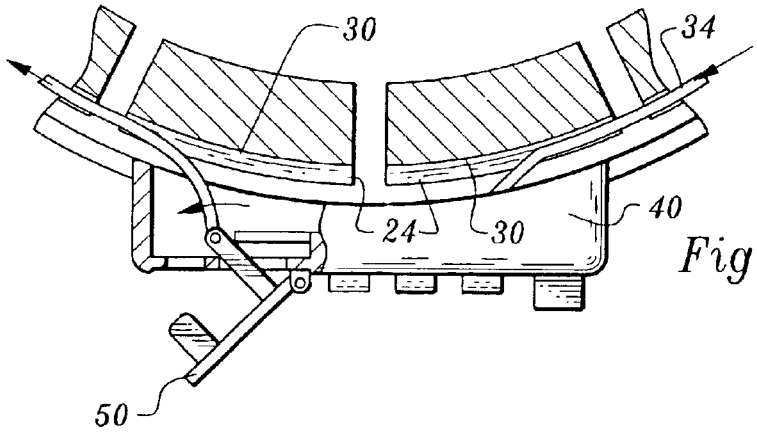
FIG. 9 is a view similar to FIG. 6, but illustrating the lever in unlatched condition.

One end of looped wire 34 is attached to lever 50, as perhaps may best be seen with reference to FIGS. 6 and 9. When the lever 50 is in the position shown in FIG. 9, the wire 34 is relatively loose, allowing the skirt portion segments 24 to be in their normal positions, as shown for example in FIG. 10. When, however, the lever is pivoted to the position shown in FIG. 6, the wire is tightened and causes the wire to bear tightly against the flexible skirt portion segments, causing the flexible skirt portion segments to flex inwardly to position the latch elements 26 under rib 16. The lock 40 serves to maintain the lever in such position (and the wire taut) until a proper combination is entered into the lock by the user and latch 42 withdrawn from the hole in the lever by actuation of push button 44. When the latch returns to its position shown in FIG. 9, the skirt portion segments 24 move outwardly due to their elastic memory and the security closure can be removed from the container.

In the arrangement illustrated, a seal 60 formed of rubber, plastic or the like is disposed below and in engagement with the top cap portion 20 for engaging the container around the top opening thereof.

Additionally, an outer lid member 62 is provided to cover the cap 18 and present a pleasing appearance. Outer lid member 62 defines an indent 64 receiving lock 40 and allowing manual access thereto. The outer lid member 62 further defines an upwardly disposed recess 66 for receiving a decorative insert 68. If desired, for example, the insert 68 can have indicia such as brand names or logos imprinted thereon.

What is claimed is:

1. A security closure for closing the top opening of a container such as a drinking glass having outwardly projecting structure extending from the outer periphery thereof adjacent to the top opening, said security closure comprising, in combination:

a cap having a top cap portion for positioning over the top opening of the container and a skirt portion projecting downwardly from said top cap portion for extending around the outwardly projecting structure of the container, said skirt portion including a plurality of flexible, independently movable skirt portion segments having inwardly projecting latch elements for selective positioning under the outwardly projecting structure of the container to prevent removal of the cap from the container and prevent access to contents of the container;

mover structure cooperable with said flexible skirt portion segments to flex said flexible skirt portion segments inwardly to position said latch elements under the outwardly projecting structure of the container; and a lock cooperable with said mover structure to maintain said flexible skirt portion segments flexed inwardly and to maintain said latch elements under the outwardly projecting structure of the container, said mover structure including an elongated constrictor member looping about said flexible skirt portion and a manually operable structural element operatively associated with said elongated constrictor member to tighten said elongated constrictor member and cause said elongated constrictor member to bear tightly against said flexible skirt portion segment, causing said flexible skirt portion segments to flex inwardly, said manually operable structural element comprising a pivoted lever attached to said elongated constrictor member, said lock cooperable with said lever to maintain said elongated constrictor member in tightened condition, said elongated constrictor member comprising a double-ended wire forming a loop, one end of said wire being attached to said lever and the other end of said wire being attached to said lock.

2. The security closure according to claim 1 wherein said flexible skirt portion segments have outer grooves receiving said elongated constrictor member to support said elongated constrictor member in position relative to said flexible skirt portion segments.

3. The security closure according to claim 1 additionally comprising a seal disposed below and in engagement with said top cap portion for engaging and sealing the container around the top opening thereof.

4. The security closure according to claim 1 wherein said lever defines a hole, said lock including a movable latch member for selectively entering said hole to prevent movement of said lever.

5. The security closure according to claim 4 wherein said lever is pivotally mounted on said lock.

6. The security closure according to claim 5 wherein said lock is a combination lock.

7. A security closure for closing the top opening of a container such as a drinking glass having outwardly projecting structure extending from the outer periphery thereof adjacent to the top opening, said security closure comprising, in combination:

a cap having a top cap portion for positioning over the top opening of the container and a skirt portion projecting downwardly from said top cap portion for extending around the outwardly projecting structure of the container, said skirt portion including a plurality of flexible, independently movable skirt portion segments having inwardly projecting latch elements for selective positioning under the outwardly projecting structure of the container to prevent removal of the cap from the container and prevent access to contents of the container;

mover structure cooperable with said flexible skirt portion segments to flex said flexible skirt portion segments inwardly to position said latch elements under the outwardly projecting structure of the container;

a lock cooperable with said mover structure to maintain said flexible skirt portion segments flexed inwardly and to maintain said latch elements under the outwardly projecting structure of the container; and an outer lid cover covering said cap.

8. The security closure according to claim 7 additionally including a decorative insert, said outer lid member defining an upwardly disposed recess for receiving said decorative insert.

9. The security closure according to claim 8 wherein said outer lid member additionally defines an indent receiving said lock and allowing manual access to said lock.

* * * * *